United States Patent [19]

Kolb

[11] 4,099,506

[45] Jul. 11, 1978

[54] IDLING ABUTMENT FOR THE GOVERNOR OF AN INJECTION PUMP OF AN AIR-COMPRESSING INTERNAL COMBUSTION ENGINE

[75] Inventor: Ulrich Kolb, Stuttgart, Fed. Rep. of Germany

[73] Assignee: Daimler-Benz Aktiengesellschaft, Fed. Rep. of Germany

[21] Appl. No.: 744,866

[22] Filed: Nov. 24, 1976

[30] Foreign Application Priority Data

Nov. 28, 1975 [DE] Fed. Rep. of Germany ..... 2553560

[51] Int. Cl.[2] ..... F02D 1/02; F02M 39/02

[52] U.S. Cl. ..... 123/140 J; 123/179 L; 123/139 ST

[58] Field of Search ..... 123/140 J, 179 L, 139 ST, 123/145 A, 145 R

[56] References Cited

U.S. PATENT DOCUMENTS

| | | | |
|---|---|---|---|
| 2,487,924 | 11/1949 | Fiedler | 123/145 A |
| 2,891,533 | 6/1959 | Clegg | 123/140 J |
| 2,965,089 | 12/1960 | Holley, Jr. | 123/139 ST |
| 2,965,092 | 12/1960 | De Claire, Jr. | 123/179 L |
| 3,485,228 | 12/1969 | Updyke et al. | 123/179 L |
| 3,727,598 | 4/1973 | Knapp | 123/179 L |
| 3,910,245 | 10/1975 | Okura | 123/179 L |

*Primary Examiner*—Charles J. Myhre
*Assistant Examiner*—Ponsholam S. Lall
*Attorney, Agent, or Firm*—Craig & Antonelli

[57] ABSTRACT

An idling abutment for the controller of an injection pump of an air-compressing internal combustion engine with combustion spaces heated by means of glow plugs, with an idling quantity increase, with a movable, adjusting and spring-loaded abutment for the quantity adjustment member of the injection pump, with a pivotal adjusting lever coupled with the drive pedal and acting on the quantity adjustment member, and with an abutment lying within the pivot range of the adjusting lever; the abutment for the adjusting lever is movable by means of an expansion element within predetermined end positions whereby the expansion element is arranged within the area of a heating coil that is at least indirectly electrically connected in parallel with the glow plugs.

21 Claims, 2 Drawing Figures

FIG. 1
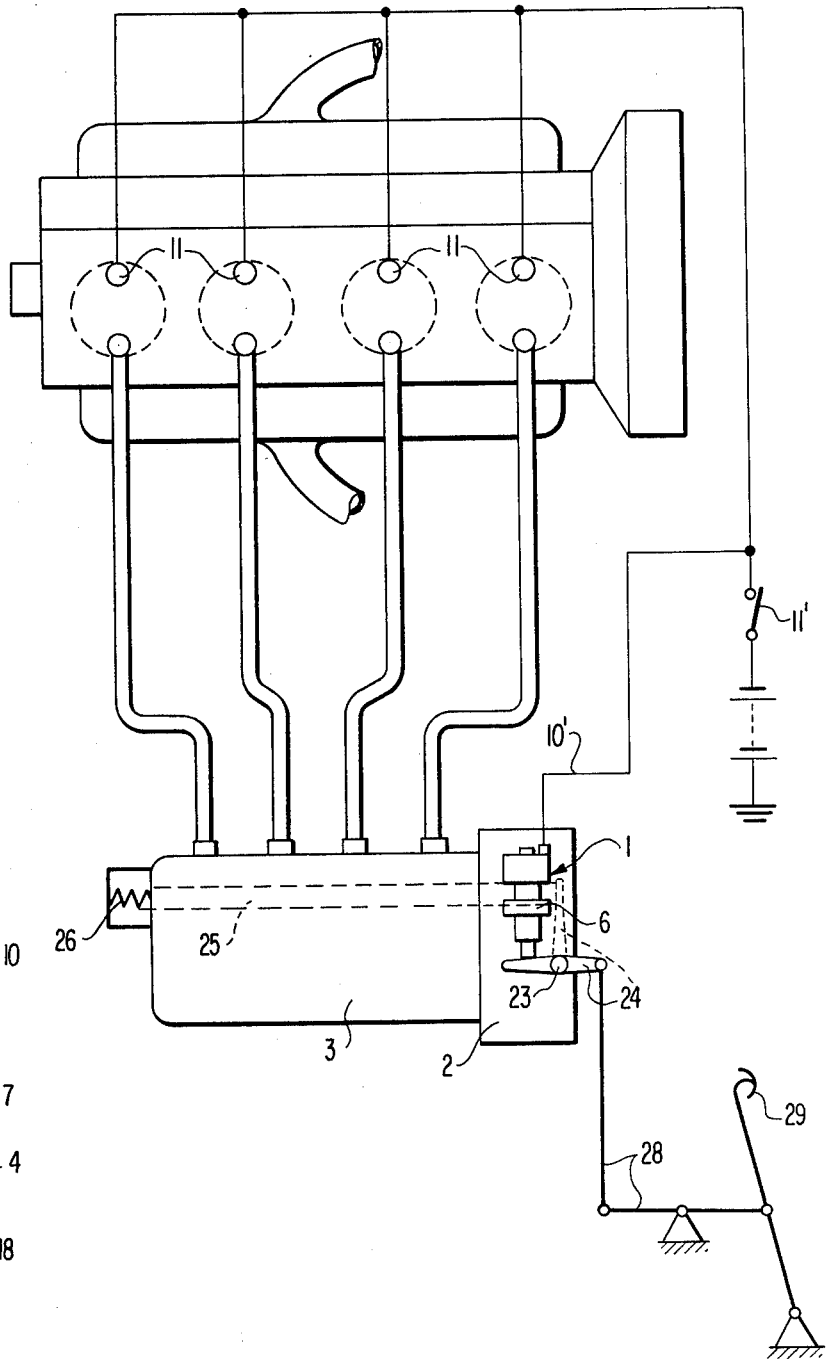
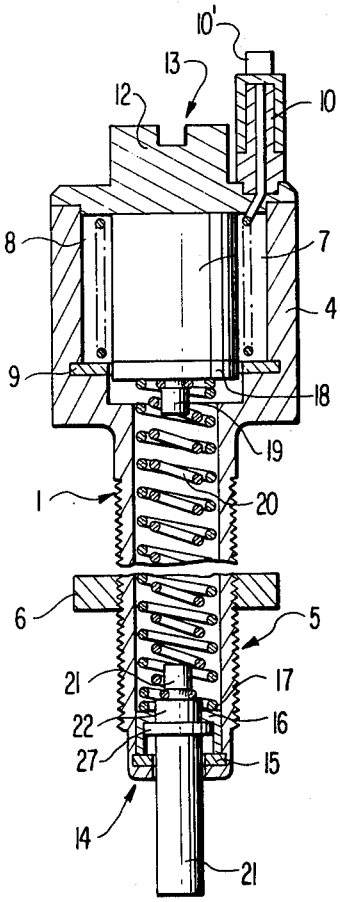
FIG. 2

IDLING ABUTMENT FOR THE GOVERNOR OF AN INJECTION PUMP OF AN AIR-COMPRESSING INTERNAL COMBUSTION ENGINE

The present invention relates to an idling abutment for the controller or governor of an injection pump of an air-compressing internal combustion engine with combustion spaces heated by means of glow plugs or hot bulbs, with an idling quantity increase, with a movable, adjustable and spring-loaded abutment for the quantity adjusting member of the injection pump which acts at least indirectly, with a linkage coupled with the drive pedal and acting on the quantity adjusting member, with an adjusting member at this linkage and with a stop located within the pivot range thereof.

At low temperatures, the idling injection quantity in the normal position of the adjusting lever does not suffice for a completely satisfactory rotation of the internal combustion engine. This can be traced back to the higher viscosity of the lubricating oil and to the still poor combustion with a cold engine. Especially with the interconnection or additional engagement of auxiliary aggregates such as a servo-steering system, an automatic transmission, an air-conditioning installation, etc., a cold engine may stall. For these reasons, it is necessary to have a possibility to increase the injection quantity in the idling operation and therewith the idling rotational speed. This takes place as a rule by way of a manually actuated button in the instrument panel which acts on the drive lever linkage by way of a Bowden cable.

Apart from the manual actuation of the starting quantity increase and the costs of the complicated pivotal connection, an erroneous adjustment of the Bowden cable cannot be excluded. The idling quantity increase can expand with such an adjustment into the uncontrolled range, which means that the rotational speed of the internal combustion engine increases uncontrollably.

It is the aim of the present invention to avoid these disadvantages by an inexpensive, automatically operating control arrangement, which precludes by means of a limited control path or travel an over-control into the uncontrolled range.

The underlying problems are solved according to the present invention in that the abutment for the adjusting lever is movable within predetermined end positions by means of an expansion element, and in that the expansion element is arranged within the area of a heating coil at least indirectly electrically connected in parallel with the glow plugs.

It is achieved thereby according to the present invention that when turning on the glow plugs for the preheating and the starting of the internal combustion engine, the heating coil is also simultaneously energized and therewith heated, which, in its turn, heats the expansion element. The axial change in length of the expansion element adjusts thereby the abutment for the adjusting lever within a predetermined range.

In order to exclude an adjustment of the abutment by the influence of the engine heat, storage or accumulator means for the storage or accumulation of changes in length of the expansion element up to a temperature of about 80° C. may be provided in the abutment. As a result thereof, an influencing of the quantity adjusting member takes place only at a temperature which lies clearly above 80° C. and simultaneously above the heat radiation of the engine.

Therebeyond, the storage or accumulator means may consist of a compression spring arranged between the movable end face of the expansion element and a movable abutment bolt and installed with prestress. The compression spring may be pressed, for example, on one pin each at the spring disk and at the abutment bolt. Furthermore, the heating coil may surround the expansion element concentrically whereby the heat acts on the same uniformly and intensively.

Additionally, the expansion element may be arranged coaxially with the abutment. As a result thereof, the arrangement is considerably simplified and it can be combined into a structural unit within a housing.

Therebeyond, the abutment may be constructed in the form of a hollow bolt or screw, whereby compression springs and the axially movable abutment bolt are arranged in the stem or shank portion of the hollow bolt and the expansion element and the heating coil are arranged in the head portion thereof.

Furthermore, the expansion element may act by way of a spring disk on two compression springs disposed concentrically one within the other, of which one and more particularly the outer one of the two springs is fixedly supported by way of a stroke-limiting ring at the shank portion of the housing whereas the other and more particularly the inner of the two compression springs which is effective as storage or accumulator means, is operatively connected with the abutment bolt to cause movement of the latter with the spring in both directions, i.e., both in tension and in compression.

The stroke-limiting ring limits the displacement path of the abutment bolt and holds the same within defined end positions which are determined, on the one hand, by a flange ring arranged at the stem or shank portion of the housing and, on the other, by a rim collar in the stroke-limiting ring. The compression spring arranged between the stroke-limiting ring and the expansion element has a prestress of about 4 kp. A recess is provided in the head portion of the housing for a spring disk or spring plate abutting at the expansion element, whereby the recess has a length which corresponds at least to the length change of the expansion element during the interaction or of the pre-heating temperature.

Finally, the inner spring may be considerably harder or stiffer than the outer spring. This entails the advantage that after exceeding the temperature limit of about 80° C., this compression spring acts as approximately rigid connection between the spring disk or plate and the abutment bolt and displaces the same to the same extent as corresponds to the expansion or elongation of the expansion element in that the prestress of 4 kp of the other spring is overcome by the pressure.

Accordingly, it is an object of the present invention to provide an idling abutment for the controller of an injection pump of an air-compressing internal combustion engine which avoids by structurally simple means the aforementioned shortcomings and drawbacks encountered in the prior art.

It is another object of the present invention to provide an idling abutment for the governor of an injection pump of an air-compressing internal combustion engine which is simple in construction, involves relatively low costs and precludes an erroneous adjustment of the idling abutment.

A further object of the present invention resides in an idling abutment for the governor of an injection pump of an air-compressing internal combustion engine which operates completely automatically and which prevents an increase of the rotational speed of the internal combustion engine to such an extent that it becomes uncontrollable.

A still further object of the present invention resides in an idling abutment of the type described above which prevents an override control into the uncontrolled ranges of the engine to thereby preclude damage to the engine.

Still another object of the present invention resides in an idling abutment for the controller of an injection pump of an air-compressing internal combustion engine which precludes an adjustment of the abutment as a result of heat radiation from the engine.

Another object of the present invention resides in an idling abutment of the type described above which is simple in construction and permits a pre-assembly into a structural unit protected by its housing.

These and other objects, features and advantages of the present invention will become more apparent from the following description when taken in connection with the accompanying drawing which shows, for purposes of illustration only, one embodiment in accordance with the present invention, and wherein:

FIG. 1 is a schematic view of an internal combustion engine with an injection pump, a controller and a quantity-adjusting member in accordance with the present invention; and FIG. 2 is a cross-sectional view through the idling abutment in accordance with the present invention for the quantity-adjusting member of the injection pump.

Referring now to the drawing wherein like reference numerals are used throughout the two views to designate like parts, the idling abutment generally designated by reference numeral 1 for the controller or governor 2 of an injection pump 3, which is illustrated in these two figures, consists of a housing 4 (FIG. 2) which is constructed in the form of a hollow screw or bolt and is screwed into a mounting support 6 by means of a thread 5. An expansion element 7 of conventional construction is arranged in the head portion of the housing 4, which is concentrically surrounded by a heating coil 8 embedded in the housing preferably within synthetic resinous material, which heating coil 8 abuts at a retaining ring 9. A plug connection 10 with a line 10' connects the heating coil 8, on the one hand, with the glow plugs or hot bulbs 11 of an internal combustion engine whereas on the other hand, the heating coil 8 is connected with ground by way of the housing 4. During the starting of the internal combustion engine and during the turning-on of the glow plugs 11 by closing a switch 11' (FIG. 1), the heating coil 8 is turned on and energized at the same time. A closure cover 12 (FIG. 2) with a screw slot 13, for the adjustment of the housing 4 in the mounting 6 by means of a work tool, closes the head portion in the one direction. An axially displaceably arranged stroke-limiting ring 16 is provided in the stem or shank portion of the housing 4 which is flanged over at the open end 14 over a ring 15; the stroke-limiting ring 16 is retained in its position by a compression spring 17 which is supported at a spring plate or disk 18 abutting at the expansion element 7. The prestress of the compression spring 17 is approximately 4 kp.

The spring plate 18 is provided with a pin 19, over which is pressed by means of a press-fit further compression spring 20 which with the other end also rests with a press fit on a pin 21 of an abutment bolt 22. The inner compression spring 20 is considerably harder than the outer spring 17 and is installed with a prestress which is so selected that the expansion element 7 can displace itself together with the spring plate 18 up to a temperature of about 80° C. without causing the abutment bolt 22 secured at the compression spring 20 to be displaced in unison therewith. Only upon exceeding the aforementioned temperature limit, the hard compression spring 20 acts on the abutment bolt 22 like an approximately rigid connection and displaces the same against an adjusting lever 24 (FIG. 1) supported on a shaft 23, which lever in its turn displaces the quantity-adjusting member 25 of the injection pump 3 against a spring-loaded abutment 26 in the direction toward an increase in quantity. The abutment bolt 22 includes a collar 27 (FIG. 2) which abuts normally at the stroke-limiting ring 16 and thereby determines the idling rotational speed of the internal combustion engine. By screwing-in or screwing-out the housing 4 into or out of the mounting 6, the housing 4 together with the abutment bolt 22 can be adjusted more or less against the adjusting lever 24 and therewith the idling rotational speed can be regulated. The adjusting lever 24 is connected with the drive pedal 29 by way of a linkage 28.

In the end phase of the pre-heating stage (at a temperature of about 80° C. and thereabove), the spring plate 18 and the compression spring 20 together with the abutment bolt 22 secured at the compression spring 20 is displaced by way of the expansion element 7 so far until the collar 27 abuts on the ring 15 fixedly connected with the housing 4, at which time the abutment bolt 22 has assumed the other end position. A further expansion of the expansion element 7 is compensated by the compression of the compression spring 20. As a result of this measure, an overcontrol into the uncontrolled range of the injection pump is reliably avoided.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An idling abutment arrangement for a controller of an injection pump of an air-compressing internal combustion engine provided with combustion spaces heated by glow plug means, and operable with idling quantity increase, comprising movable, adjustable and spring-loaded abutment means operable at least indirectly upon a quantity adjustment member of the injection pump, a drive pedal, transmitting means including a pivotal adjusting lever coupled with the drive pedal and operable to act on the quantity adjustment member, and an abutment means located within the movement area of said adjusting lever, characterized in that the abutment means is movable within predetermined end positions by means of an expansion element, and in that the expansion element is arranged within the area of a heating means which is at least indirectly electrically connected in parallel with the glow plug means, and further characterized in that storage means are provided in the abutment means for the storage of changes in the length of the expansion element up to a predetermined temperature.

2. An idling abutment arrangement according to claim 1, characterized in that the heating means is a heating coil.

3. An idling abutment arrangement according to claim 1, characterized in that said predetermined temperature is about 80° C.

4. An idling abutment arrangement according to claim 1, characterized in that the abutment means is constructed in the form of a hollow screw means, whereby compression spring means and an axially movable abutment bolt are arranged in the hollow shank portion of the hollow screw means and the expansion element and the heating means are arranged in the head portion thereof.

5. An idling abutment arrangement according to claim 1, characterized in that the storage means include a compression spring means installed with prestress between the movable end face of the expansion element and a movable abutment bolt.

6. An idling abutment arrangement according to claim 5, characterized in that the heating means substantially concentrically surrounds the expansion element.

7. An idling abutment arrangement according to claim 6, characterized in that the expansion element is arranged substantially coaxially with the abutment means.

8. An idling abutment arrangement according to claim 7, characterized in that the abutment means is constructed in the form of a hollow screw means, whereby the compression spring means and the axially movable abutment bolt are arranged in the hollow shank portion of the hollow screw means and the expansion element and the heating means are arranged in the head portion thereof.

9. An idling abutment arrangement with a housing according to claim 8, characterized in that the expansion element acts by way of a spring plate on two concentrically nested compression spring means, of which one spring means is securely supported at the shank portion of the housing by way of a stroke-limiting ring whereas the other spring means is operatively connected with the abutment bolt for movement in unison therewith in at least one direction.

10. An idling abutment arrangement according to claim 9, characterized in that said one spring means is the outer spring and the other spring means is the inner spring which is effective as storage means.

11. An idling abutment arrangement according to claim 10, characterized in that the other spring means is considerably harder than the one spring means.

12. An idling abutment arrangement according to claim 11, characterized in that said spring means are compression coil springs.

13. An idling abutment arrangement according to claim 12, characterized in that the heating means is a heating coil.

14. In an arrangement for the control of the quantity of fuel supplied by an injection pump of an air-compressing internal combustion engine of the type wherein a heat-expansible means acts upon a displaceable abutment member which is operable upon a quantity adjustment member of the injection pump for altering the quantity of fuel supplied by said pump, the improvement comprising:

electrical heating means for causing an expansion of said heat expansible means; and storage means for enabling said heat expansible means to expand in length without causing said abutment member to be displaced until a predetermined temperature is reached, and for enabling displacement of said abutment member by said heat expansible means after said predetermined temperature is reached.

15. An arrangement according to claim 14, characterized in that the heating means substantially concentrically surrounds the heat expansible means.

16. An arrangement according to claim 14, characterized in that the heat expansible means is arranged substantially coaxially with the abutment member.

17. An arrangement according to claim 14, wherein said predetermined temperature is 80° C.

18. An arrangement according to claim 14, further comprising override means for limiting the stroke of said abutment member and accumulating further increases in the length of said heat expansible means, whereby overcontrol of said pump is avoided.

19. An arrangement according to claim 18, comprising a housing and characterized in that the heat expansible means acts by way of a spring plate on two concentrically nested compression spring means, of which one spring means is securely supported at a shank portion of the housing by way of a stroke-limiting ring whereas the other spring means is operatively connected with the abutment member for movement in unison therewith in at least one direction, said one spring means forming part of said storage means, and said stroke-limiting ring and other spring means forming part of said override means.

20. An idling abutment arrangement according to claim 19, characterized in that said one spring means is the outer spring and the other spring means is the inner spring.

21. An idling abutment arrangement according to claim 19, characterized in that the other spring means is considerably harder than the one spring means.

* * * * *